United States Patent [19]

Dennis

[11] Patent Number: 4,739,845

[45] Date of Patent: Apr. 26, 1988

[54] NOZZLE FOR ROTARY BIT

[75] Inventor: Mahlon D. Dennis, Kingwood, Tex.

[73] Assignee: Strata Bit Corporation, Houston, Tex.

[21] Appl. No.: 10,319

[22] Filed: Feb. 3, 1987

[51] Int. Cl.[4] ..... E21B 10/60

[52] U.S. Cl. ..... 175/393; 175/340; 175/424

[58] Field of Search ..... 175/339, 340, 393, 418, 175/424; 239/227, 243, 246, 251, 381, 600; 166/222, 223

[56] References Cited

U.S. PATENT DOCUMENTS

| | | | |
|---|---|---|---|
| 2,529,262 | 11/1950 | Ratliff | 299/69 |
| 2,685,431 | 8/1954 | James | 255/1.6 |
| 2,855,182 | 10/1958 | Payne | 255/314 |
| 2,877,988 | 3/1959 | Cameron et al. | 255/301 |
| 2,911,196 | 11/1959 | Cameron et al. | 255/301 |
| 3,125,297 | 3/1964 | Copeland et al. | 239/263 |
| 4,073,438 | 2/1978 | Meyer | 239/227 |
| 4,175,626 | 11/1979 | Tummel | 166/223 |
| 4,213,354 | 7/1980 | Dahinden | 82/1 C |
| 4,365,758 | 12/1982 | Schaming | 239/600 |
| 4,369,850 | 1/1983 | Barker | 175/393 |
| 4,542,798 | 9/1985 | Madigan | 175/340 |
| 4,687,066 | 8/1987 | Evans | 166/222 |

*Primary Examiner*—Stephen J. Novosad
*Assistant Examiner*—Terry Lee Melius
*Attorney, Agent, or Firm*—Burns, Doane, Swecker & Mathis

[57] ABSTRACT

A rotary drill bit comprises a bit body carrying a plurality of cutting elements and a main conduit for conducting drilling fluid. A plurality of nozzle bodies is rotatably seated in bores of the bit body. Each nozzle body includes a plurality of passages extending therethrough for conducting drilling fluid in such manner that the exiting fluid causes the nozzle body to rotate about its longitudinal axis. The exiting fluid is thus distributed in a wider pattern.

4 Claims, 1 Drawing Sheet

Fig. 1
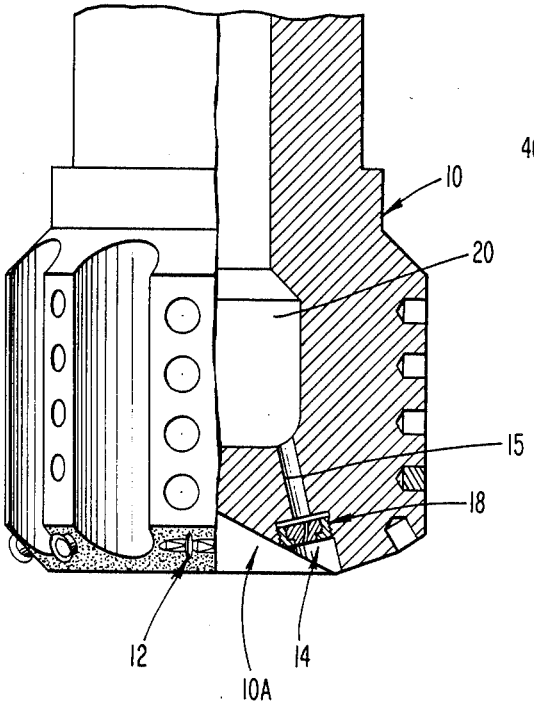
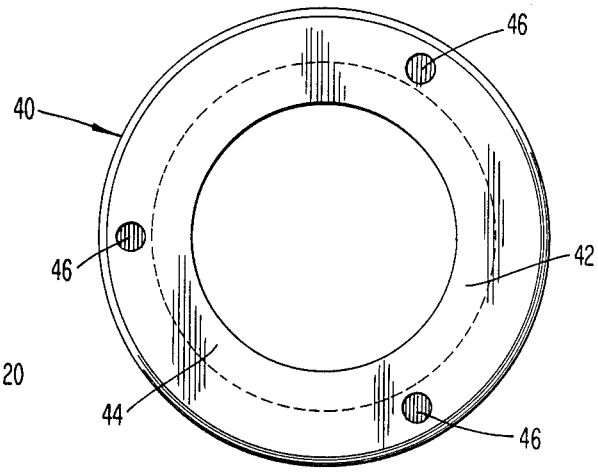
Fig. 5
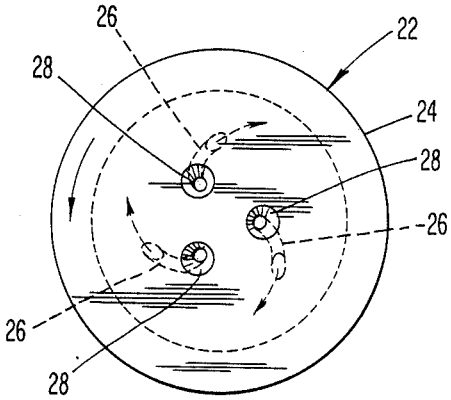
Fig. 3
Fig. 2
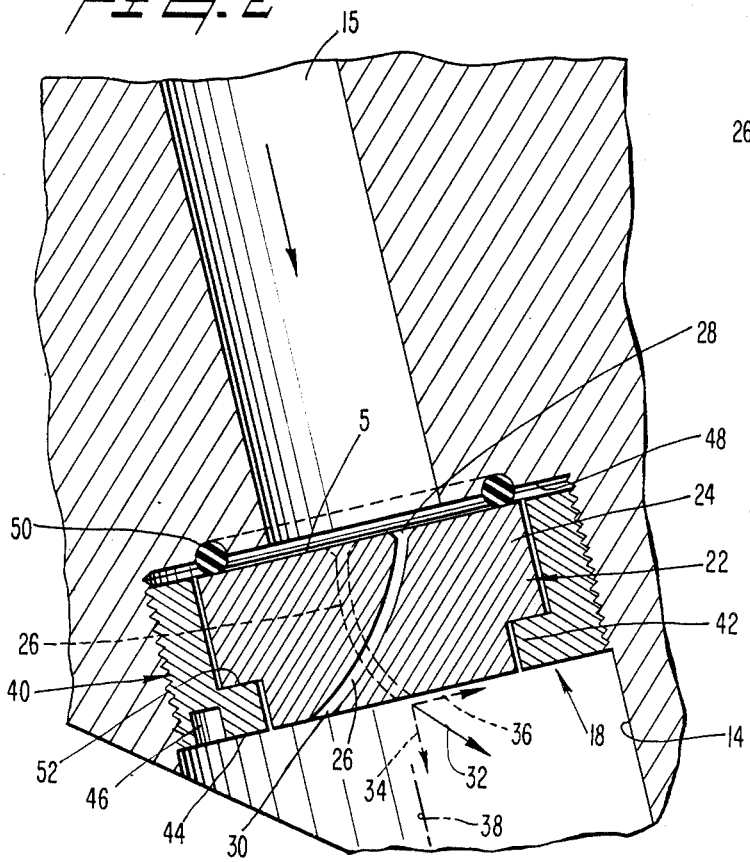
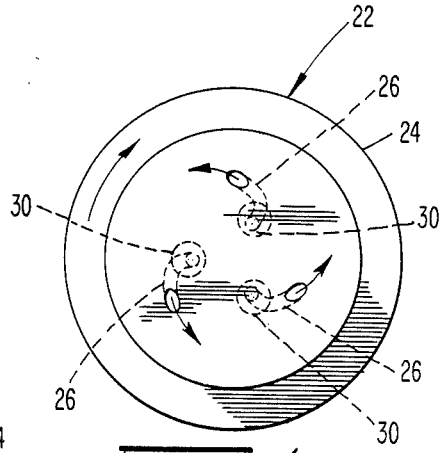
Fig. 4

NOZZLE FOR ROTARY BIT

BACKGROUND OF THE INVENTION

The present invention relates to rotary drill bits for cutting through subterranean formations and, in particular, to nozzles mounted in the drill bit for discharging drilling fluid.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the borehole. The drilling fluid is delivered to the drill bit downwardly through a passage in the drill stem and is ejected outwardly through nozzles disposed in bores in the cutting face of the drill bit. The ejected drilling fluid is directed outwardly through the nozzles at high speed to aid in cutting, and to flush and cool the cutter elements.

It is desirable that the drilling fluid be distributed over as wide an area as possible to optimize the cleaning and cooling of the cutting elements. This result could be achieved by maximizing the number of nozzles. The number of nozzles which are able to be utilized, however, is limited by a number of factors, such as the fact that the fluid pressure to each nozzle is reduced as the number of nozzles is increased. This shortcoming cannot be avoided by making the nozzle channels smaller, because the channels would then clog too easily. Also, the nozzles occupy surface area which could otherwise be occupied by cutting elements.

SUMMARY OF THE INVENTION

The present invention relates to a rotary drill bit comprising a bit body carrying a plurality of cutting elements, a main conduit for conducting drilling fluid, and a plurality of bores communicating with the main conduit. A plurality of nozzle bodies is rotatably seated in respective ones of the bores. Each nozzle body includes a plurality of passages extending therethrough for conducting drilling fluid. Each of the passages includes an exit end oriented to discharge drilling fluid in a direction having a tangential component causing the nozzle body to rotate about a longitudinal axis of the nozzle body. A securing mechanism secures each nozzle body in its respective channel while permitting rotation of the nozzle body about its longitudinal axis. Preferably, the securing mechanism comprises an externally threaded sleeve which is insertable around the nozzle body and is threadedly secured to internal threads of the channel.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 1 is a side elevational view, with a portion thereof broken away, of a drill bit according to the present invention;

FIG. 2 is a longitudinal sectional view taken through the drill bit and through a nozzle according to the present invention;

FIG. 3 is a rear end view of a nozzle body according to the present invention;

FIG. 4 is a front end view of the nozzle body; and

FIG. 5 is a front view of a securing sleeve according to the present invention.

DETAILED DESCRIPTION OF A PREFERRED EMBODIMENT OF THE INVENTION

Depicted in FIG. 1 is a rotary drill bit body 10 having a forwardly facing surface 10A which carries a plurality of cutting elements 12.

A pluraity of bores 14 are provided in the bit body for the reception of nozzles 18 for discharging streams of drilling fluid. The drilling fluid is conducted to the bores 14 through conduits 15 extending from the bores 14 to a central passage 20 in the bit body 10. The jet streams aid in the cutting of the formation, cooling of the cutting elements, and flushing of cuttings to the top of the borehole.

Each nozzle 18 comprises a nozzle body 22 having a radially projecting flange 24 at a rear end thereof. Extending through the nozzle body are a plurality of nozzle passages 26. Each nozzle passage includes an inlet end 28 communicating with a supply of pressurized drilling fluid, and an outlet end 30 extending such that the drilling fluid exits the nozzle body in a direction 32 having a longitudinal component 34 and a tangential component 36. As will be discussed later, such an arrangement enables the exiting drilling fluid to rotate the nozzle body about a longitudinal axis 38 thereof.

The nozzle body is mounted in one of the bores 14 of the bit body by means of a threaded securing sleeve 40. The threaded sleeve carries external threads which are threadedly receivable in internal threads of the bore 14. The sleeve include an overhanging lip 42 positioned to engage the flange 24 of the nozzle body when the sleeve 40 is inserted over the nozzle body. The sleeve includes a front face 44 which contains a plurality of recesses 46 adapted to receive the prongs of a turning tool (not shown), to enable the sleeve to be screwed into the bore 14.

The bore 14 terminates in a shoulder 48 which carries an O-ring 50. By screwing in the sleeve, a rear surface 51 of the nozzle body 22 can be pushed against the O-ring 50 with sufficient force to create a fluid seal while enabling the nozzle to rotate.

If desired, an anti-friction coating can be placed on the surface 52 of the lip 42 which engages the flange 24, to minimize friction therebetween during rotation of the nozzle body.

In practice, the discharge of high-pressure drilling fluid through the exits of the passages 26 causes the nozzle body 22 to rotate in an opposite direction in relation to the tangential component of travel of the exiting fluid. This results in a wide sweeping distribution of drilling fluid which maximizes the cleaning and cooling of the cutting elements.

Also, the possibility of drilling fluid disposed in certain regions of the borehole becoming stagnant is minimized by the sweeping action of the discharged fluid which will impart movement to fluid in virtually all regions of the borehole.

It will be appreciated that other mounting and/or sealing arrangements for the nozzle body may be utilized which permit the nozzle body to rotate under the action of the discharged drilling fluid.

If desired, a conventional retaining ring can be disposed in front of the securing sleeve 40 to retain the sleeve against counter-rotation.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What I claim is:

1. A rotary drill bit comprising:

a bit body including a forwardly facing surface carrying a plurality of cutting elements, said body including a main conduit for conducting drilling fluid, and a plurality of bores communicating with said main conduit, a plurality of nozzle bodies rotatably seated in respective ones of said bores, each nozzle body defining a longitudinal axis and including a plurality of passages extending through said body for conducting drilling fluid, each of said passages including an exit end oriented to discharge drilling fluid in a direction having a forward component and a tangential component which is tangential relative to said axis for causing said nozzle body to rotate relative to said bit body about said longitudinal axis in a direction opposite said tangential direction, and mounting means for mounting each nozzle body in its respective bore for rotation of said nozzle body about said longitudinal axis.

2. A drill bit according to claim 1 including sealing means forming a fluid seal between said nozzle body and said bit body.

3. A drill bit according to claim 2, wherein said sealing means comprises an O-ring arranged to be compressed between a radial shoulder of said bore and a rear surface of said flange.

4. A drill bit according to claim 1, wherein said nozzle body includes an enlarged flange, said securing means comprising an externally threaded sleeve which is insertable around said nozzle body and is threadedly securable to internal threads of said bore, said sleeve including a lip engageable with said flange to retain said nozzle body in its respective bore.

* * * * *